US011492232B2

(12) United States Patent
Li et al.

(10) Patent No.: US 11,492,232 B2
(45) Date of Patent: Nov. 8, 2022

(54) ELEVATOR BALANCE WEIGHT RESCUE DEVICE, AN ELEVATOR AND AN ELEVATOR BALANCE WEIGHT RESCUE METHOD

(71) Applicant: Otis Elevator Company, Farmington, CT (US)

(72) Inventors: Qing Li, Tianjin (CN); Kai Kang, Tianjin (CN); ShengYu Wang, Tianjin (CN); Hebin Bai, Tianjin (CN); Jianjia Li, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 447 days.

(21) Appl. No.: 16/545,346

(22) Filed: Aug. 20, 2019

(65) Prior Publication Data

US 2020/0055699 A1 Feb. 20, 2020

(30) Foreign Application Priority Data

Aug. 20, 2018 (CN) ..... 201810948685.0

(51) Int. Cl.
*B66B 5/02* (2006.01)

(52) U.S. Cl.
CPC ..... *B66B 5/027* (2013.01); *B66B 5/02* (2013.01)

(58) Field of Classification Search
CPC ..... B66B 5/02; B66B 5/027; B66B 5/044; B66B 11/008; B66B 11/005
See application file for complete search history.

(56) References Cited

U.S. PATENT DOCUMENTS 5,878,845 A * 3/1999 Wang ..... B66B 5/027 187/272
6,116,380 A 9/2000 Wang
(Continued)

FOREIGN PATENT DOCUMENTS

CN 201485153 U 5/2010
CN 205222331 U 5/2016
(Continued)

OTHER PUBLICATIONS

Machine Translation of CN 2014-85153.*
(Continued)

*Primary Examiner* — Diem M Tran
(74) *Attorney, Agent, or Firm* — Cantor Colburn LLP

(57) ABSTRACT

An elevator balanced-load rescue device, an elevator, and an elevator balanced-load rescue method are provided by the present disclosure. The elevator balanced-load rescue device includes: a clamping wheel set including a driving wheel and a driven wheel that cooperate with each other; wherein the clamping wheel set has a clamping position and a releasing position; in the clamping position, the driving wheel and the driven wheel move toward each other to clamp a traction belt connected between an elevator car and an elevator counterweight; and in the releasing position, the driving wheel and the driven wheel move opposite to each other to release the traction belt; a transmission shaft which has a first end connected to the driving wheel of the clamping wheel set, and which transmits a torque to the driving wheel; and an energy storage device associated with the transmission shaft.

22 Claims, 5 Drawing Sheets

(56) References Cited

U.S. PATENT DOCUMENTS

| | | | | |
|---|---|---|---|---|
| 6,464,041 | B1 | 10/2002 | Chen | |
| 6,739,431 | B1 * | 5/2004 | Wang | B66B 5/027 187/306 |
| 7,316,297 | B2 | 1/2008 | Wang | |
| 7,392,885 | B2 | 7/2008 | Wang | |
| 7,614,481 | B2 | 11/2009 | Okamoto et al. | |
| 9,567,196 | B2 | 2/2017 | Horndacher et al. | |
| 2017/0008732 | A1 | 1/2017 | Shiraishi et al. | |

FOREIGN PATENT DOCUMENTS

| | | | | |
|---|---|---|---|---|
| CN | 110002317 | A | * | 7/2019 |
| DE | 3523187 | A1 | * | 1/1987 |
| DE | 102011118544 | A1 | | 5/2013 |
| EP | 1588974 | A1 | | 10/2005 |
| JP | 2003312954 | A | | 11/2003 |
| JP | 2012121699 | A | | 6/2012 |
| WO | 2011029727 | A1 | | 3/2011 |
| WO | 2013035174 | A1 | | 3/2013 |

OTHER PUBLICATIONS

Machine Translation of DE 10 2011 118 544.*
Versa Drives, "VersaResQ—An Automatic Rescue Device for Elevators" Computer Controls Corporation, May 2009, 2 pages.
European Search Report for application EP 19192672.4, dated Feb. 11, 2020, 90 pages.

* cited by examiner

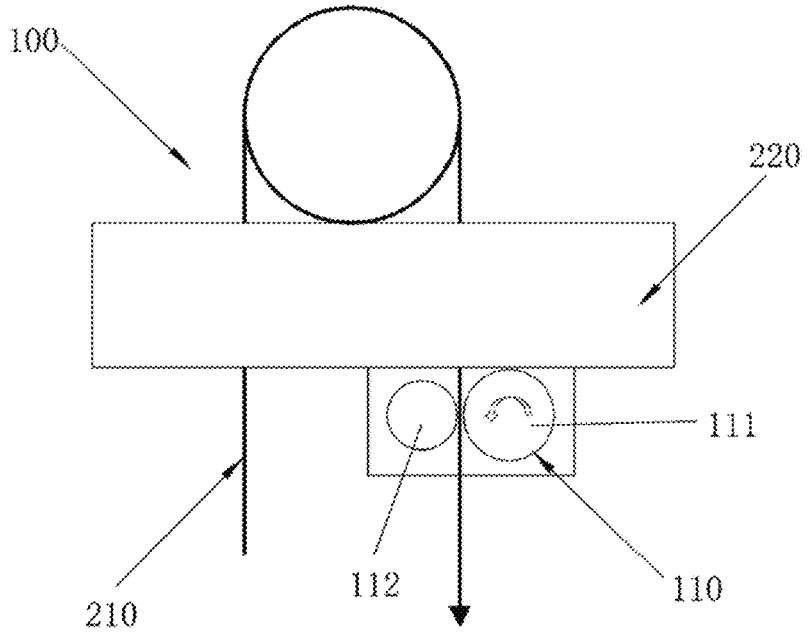
【FIG. 1】
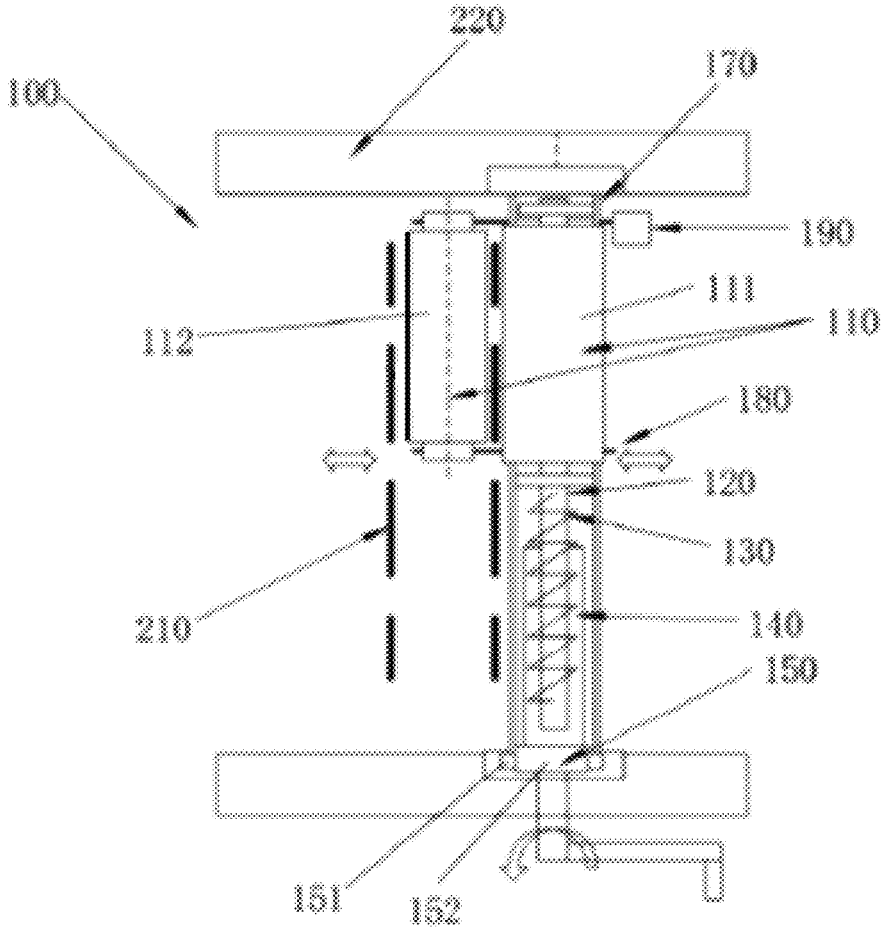
【FIG. 2】

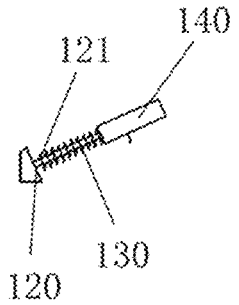
【FIG. 3】
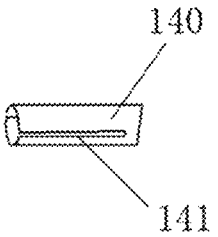
【FIG. 4】
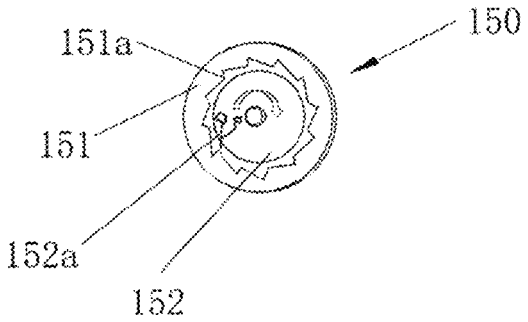
【FIG. 5】

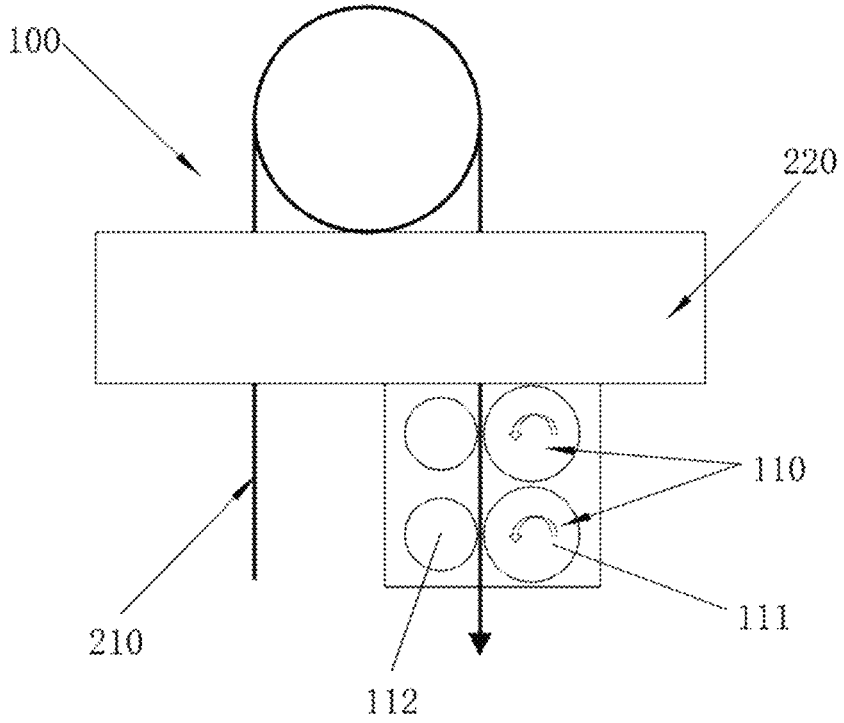
【FIG. 6】
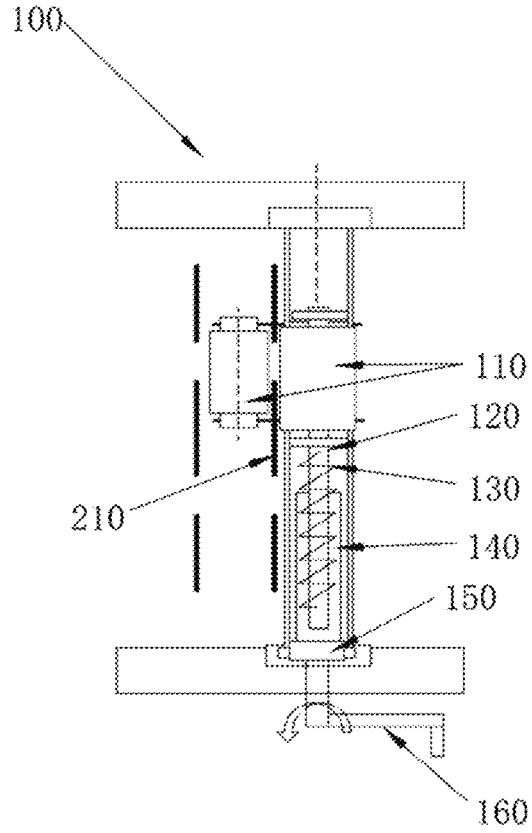
【FIG. 7】

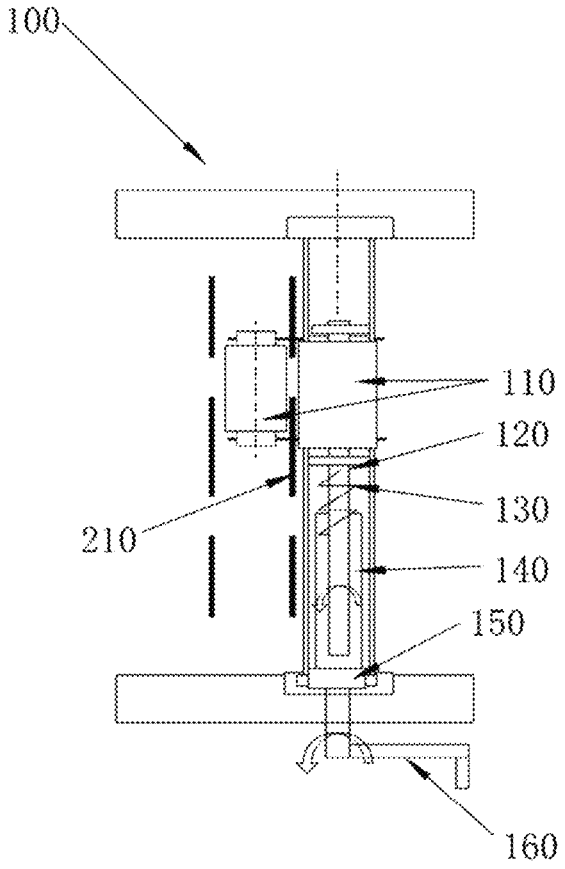
【FIG. 8】

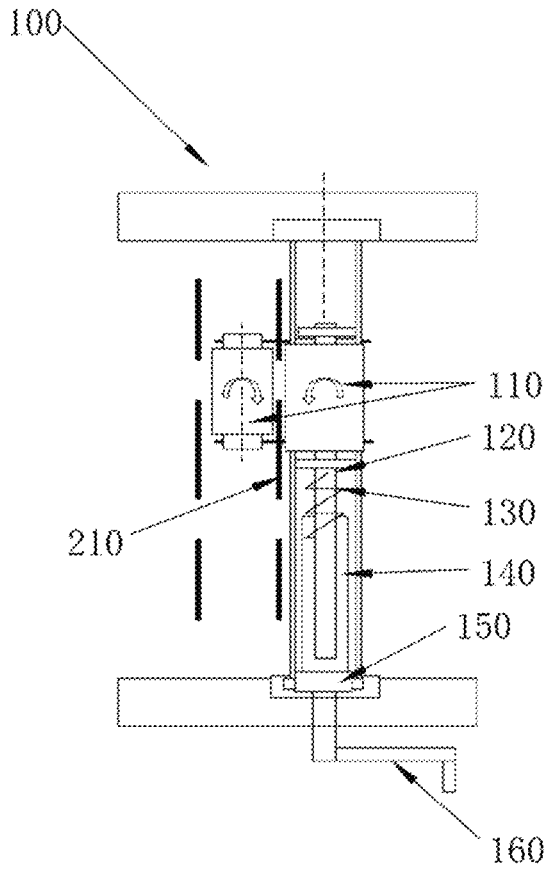
【FIG. 9】

ELEVATOR BALANCE WEIGHT RESCUE DEVICE, AN ELEVATOR AND AN ELEVATOR BALANCE WEIGHT RESCUE METHOD

FOREIGN PRIORITY

This application claims priority to Chinese Patent Application No. 201810948685.0, filed Aug. 20, 2018, and all the benefits accruing therefrom under 35 U.S.C. § 119, the contents of which in its entirety are herein incorporated by reference.

FIELD OF THE INVENTION

The present disclosure relates to the field of elevators, and in particular, to an elevator balanced-load rescue device and an elevator balanced-load rescue method.

BACKGROUND OF THE INVENTION

As a tool to improve passenger's walking between floors or shorten a walking distance of passengers, passenger conveying devices are very common in daily life. As an example, escalators and lift elevators used between floors of commercial buildings as well as moving walkways usually used in large airports are very common.

For lift elevators, it is often necessary to provide a dedicated hoistway, a car running in the hoistway, and a counterweight that forms a balance with the car. When driven by a drive device, a traction belt drives the car and the counterweight to move up and down so as to transport passengers to the designated floor.

During this process, if the lift elevator has a failure and is stuck between floors, the passenger cannot be safely and effectively evacuated from the car. In such accidents, sufficient safety measures are required to ensure that passengers in the elevator can smoothly leave the car.

At present, if there is a difference in weight between the car and the counterweight, the car can be moved when a tractor brake is released, and the rescue can be performed in a conventional brake releasing way; and if the car and the counterweight reach a balance, it is possible to suspend a weight on a speed governor in the elevator hoistway so that the elevator car descends to an adjacent floor and that the passenger can leave safely. This type of rescue requires the corresponding mechanical equipment to work alternately in a machine room and in the hoistway for many times, which will greatly consume both the time and the labor. In addition, if the car stops right at a position that hinders entry of the mechanical equipment into the hoistway, this rescue mode cannot be implemented.

Therefore, how to provide an elevator balanced-load rescue device with high efficiency and high applicability has become an urgent technical problem to be solved.

SUMMARY OF THE INVENTION

The present disclosure aims to provide an elevator balanced-load rescue device with high rescue efficiency and high applicability.

The present disclosure also aims to provide an elevator having an elevator balanced-load rescue device with high rescue efficiency and high applicability.

The present disclosure also aims to provide an elevator balanced-load rescue method with high rescue efficiency and high applicability.

In order to achieve the objects of the present disclosure, according to an aspect of the present disclosure, there is provided an elevator balanced-load rescue device comprising: a clamping wheel set including a driving wheel and a driven wheel that cooperate with each other; wherein the clamping wheel set has a clamping position and a releasing position; in the clamping position, the driving wheel and the driven wheel move toward each other to clamp a traction belt connected between an elevator car and an elevator counterweight; and in the releasing position, the driving wheel and the driven wheel move opposite to each other to release the traction belt; a transmission shaft which has a first end connected to the driving wheel of the clamping wheel set, and which transmits a torque to the driving wheel; and an energy storage device associated with the transmission shaft; wherein the energy storage device is configured to store a mechanical energy, and to convert the mechanical energy into a torque to be transmitted to the transmission shaft.

Optionally, the energy storage device includes: a torsion spring disposed around the transmission shaft; a sleeve sleeved over the torsion spring; and a ratchet wheel assembly connected to the sleeve; wherein two ends of the torsion spring are connected to the transmission shaft and the sleeve respectively, a rotational movement of the ratchet wheel assembly is transmitted to the torsion spring via the sleeve and is converted into an elastic energy of the torsion spring, and the elastic energy of the torsion spring is transmitted to the transmission shaft and is converted into a rotational movement of the transmission shaft.

Optionally, a first end of the torsion spring is connected to a first end of the transmission shaft, a second end of the torsion spring is connected to the sleeve, and a movement gap exists between the sleeve and the first end of the transmission shaft.

Optionally, a positioning protrusion is disposed on the transmission shaft, a first end of the torsion spring is wound around the positioning protrusion; and/or a mounting groove is disposed at one end of the sleeve that faces the transmission shaft, and a second end of the torsion spring is snapped into the mounting groove.

Optionally, the ratchet wheel assembly includes: a ratchet wheel having ratchets disposed on an inner circumference; and a roller having a pawl, the pawl being engaged with the ratchets; wherein the roller is connected to the sleeve and is capable of rotating relative to the ratchet wheel, and the ratchet wheel is fixed.

Optionally, a driving handle is further included, which is connected to the sleeve via the ratchet wheel assembly; wherein when the driving handle rotates in a first direction, the roller rotates relative to the ratchet wheel and drives the sleeve to rotate; and when the driving handle rotates in a second direction opposite to the first direction, the pawl on the roller limits a rotation of the roller relative to the ratchet wheel.

Optionally, a base frame is further included, to which the ratchet wheel is fixed.

Optionally, a tensioning device is further included, which is associated with the driving wheel and the driven wheel of the clamping wheel set; wherein in the clamping position, the tensioning device tensions the driving wheel and the driven wheel to clamp the traction belt; and in the releasing position, the tensioning device releases the tensioning of the driving wheel and the driven wheel to release the traction belt.

Optionally, the tensioning device includes a linkage mechanism connected between the driving wheel and the driven wheel.

Optionally, a surface layer of the driving wheel and/or the driven wheel of the clamping wheel set is made of a non-metallic material.

Optionally, a base frame is further included, to which the clamping wheel set, the transmission shaft and the energy storage device are connected.

Optionally, both ends of the base frame are installed to a machine beam or a machine base in an elevator machine room.

Optionally, the clamping wheel set is disposed adjacent to an end of the base frame; or the clamping wheel set is disposed in a middle portion of the base frame.

Optionally, a safety switch connected to an elevator circuit is further included, which is associated with the clamping wheel set; wherein the safety switch shuts down a power supply of the elevator when the driving wheel and the driven wheel of the clamping wheel set clamp the traction belt.

Optionally, the clamping wheel set has a width over which one or more traction belts are clamped.

Optionally, the clamping wheel set is disposed above an elevator car or above an elevator counterweight.

In order to achieve the objects of the present disclosure, according to another aspect of the present disclosure, an elevator is provided, which includes one or more sets of the elevator balanced-load rescue devices as described above.

Optionally, a plurality of sets of the elevator balanced-load rescue devices are respectively disposed in an elevator machine room in a vertical direction.

Optionally, clamping wheel sets of a plurality of sets of the elevator balanced-load rescue devices are respectively disposed above an elevator car and/or above an elevator counterweight.

In order to achieve the objects of the present disclosure, according to still another aspect of the present disclosure, an elevator balanced-load rescue method is further provided, which is used for an elevator balanced-load rescue device, the elevator balanced-load rescue device including: a clamping wheel set having a driving wheel and a driven wheel configured to clamp and release a traction belt; an energy storage device configured to store and transmit energy; and a transmission shaft configured to connect the energy storage device and the clamping wheel set; wherein in a rescue mode, the method includes: powering off and closing a tractor brake of the elevator so that an elevator car and an elevator counterweight are locked and stationary, and controlling the clamping wheel set to clamp the traction belt; controlling the energy storage device to store a mechanical energy and converting the mechanical energy into a torque to be transmitted to the transmission shaft; driving the transmission shaft to transmit the torque to the driving wheel; and releasing the tractor brake of the elevator so that the driving wheel drives the driven wheel and the traction belt to move, thereby driving the elevator car and the elevator counterweight to move.

Optionally, in a case that the energy storage device includes a torsion spring, a sleeve, and a ratchet wheel assembly, the method further includes: when the roller rotates relative to the ratchet wheel in a first direction, transmitting a rotational movement of the roller to the torsion spring via the sleeve and converting the rotational movement into an elastic energy of the torsion spring, and transmitting the elastic energy of the torsion spring to the transmission shaft and converting it into a rotational movement of the transmission shaft; and when the roller rotates in a second direction opposite to the first direction, limiting a rotation of the roller relative to the ratchet wheel by a pawl on the roller, and maintaining the sleeve, the torsion spring and the transmission shaft in the current state.

Optionally, in a case that the elevator balanced-load rescue device includes a safety switch which is connected to an elevator circuit and associated with the clamping wheel set, the method further includes: shutting down a power supply of the elevator by the safety switch when the driving wheel and the driven wheel of the clamping wheel set clamp the traction belt.

According to the elevator balanced-load rescue device, the elevator and the elevator balanced-load rescue method of the present disclosure, through a cooperative arrangement of the clamping wheel set, the transmission shaft and the energy storage device, on one hand, the rescue time and the manpower required for rescue are reduced, and on the other hand, an easier installation of the elevator balanced-load rescue device to the elevator system is enabled, and a strong applicability is presented; moreover, it is not required to perform rescue operations in the hoistway, making the rescue work more convenient.

BRIEF DESCRIPTION OF THE DRAWINGS

FIG. 1 is a schematic diagram of an embodiment of an elevator balanced-load rescue device according to the present disclosure at a first viewing angle.

FIG. 2 is a schematic diagram of an embodiment of an elevator balanced-load rescue device according to the present disclosure at a second viewing angle.

FIG. 3 is a schematic diagram of an energy storage device of an embodiment of an elevator balanced-load rescue device according to the present disclosure.

FIG. 4 is a schematic diagram of a sleeve of an embodiment of an elevator balanced-load rescue device according to the present disclosure.

FIG. 5 is a schematic diagram of a ratchet wheel assembly of an embodiment of an elevator balanced-load rescue device according to the present disclosure.

FIG. 6 is a schematic diagram of another embodiment of an elevator balanced-load rescue device according to the present disclosure.

FIG. 7 is a first schematic diagram of a working process of an embodiment of an elevator balance-load rescue device according to the present disclosure.

FIG. 8 is a second schematic diagram of a working process of an embodiment of an elevator balance-load rescue device according to the present disclosure.

FIG. 9 is a third schematic diagram of a working process of an embodiment of an elevator balance-load rescue device according to the present disclosure.

DETAILED DESCRIPTION OF THE EMBODIMENT(S) OF THE INVENTION

The present disclosure herein provides embodiments of an elevator balanced-load rescue device in connection with the drawings. Referring to FIGS. 1 and 2, an elevator balanced-load rescue device is illustrated. The elevator balanced-load rescue device 100 includes a clamping wheel set 110, a transmission shaft 120, and an energy storage device.

The clamping wheel set 110 includes a driving wheel 111 and a driven wheel 112 that cooperate with each other and are respectively disposed on both sides of a traction belt 210 connected between an elevator car and an elevator counterweight. During use, the clamping wheel set 110 has a clamping position and a releasing position: in the clamping position, the driving wheel 111 and the driven wheel 112 move toward each other to clamp the traction belt 210. At this point, when the driving wheel 111 is driven to rotate, the driven wheel 112 and the traction belt 210 can be driven by the driving wheel 111 through a friction force to move therewith so that the traction belt drives the elevator car and the elevator counterweight to move and the elevator car is lifted or lowered to an appropriate floor to evacuate passengers or perform maintenance. In the releasing position, the driving wheel 111 and the driven wheel 112 move opposite to each other to release the traction belt 210. At this point, the elevator balanced-load rescue device and the elevator system remain separated, and no interference to a normal operation of the elevator system will be caused at all.

In addition, a first end of the transmission shaft 120 is connected to the driving wheel 111 of the clamping wheel set 110, and the other end thereof is connected to the energy storage device for transmitting a torque from the energy storage device to the driving wheel 111 for the purpose of driving the driving wheel 111 or the entire clamping wheel set 110. The energy storage device associated with the transmission shaft 120 is configured to store a mechanical energy and to convert the mechanical energy into a torque to be transmitted to the transmission shaft 120.

In this configuration, through a cooperative arrangement of the aforementioned clamping wheel set 110, the transmission shaft 120 and the energy storage device, on one hand, the rescue time and the manpower required for rescue are reduced in the elevator balanced-load rescue device, and on the other hand, an easier installation of the elevator balanced-load rescue device to the elevator system is enabled, and a strong applicability is presented; moreover, it is not required to perform rescue operations in the hoistway, making the rescue work more convenient.

The various elements and components in the elevator balanced-load rescue device 100 and their connection and arrangement relationships will be described below with reference to the accompanying drawings.

Firstly, referring to FIGS. 3 to 5, the energy storage device in the illustrated embodiment includes a torsion spring 130, a sleeve 140, and a ratchet wheel assembly 150. The torsion spring 130 is disposed around the transmission shaft 120, and the sleeve 140 is sleeved over the torsion spring 130 and connected to the ratchet wheel assembly 150. Two ends of the torsion spring 130 are respectively connected to the transmission shaft 120 and the sleeve 140, so that a rotational movement of the ratchet wheel assembly 150 is transmitted to the torsion spring 130 via the sleeve 140 and is converted into an elastic energy of the torsion spring 130, and the elastic energy of the torsion spring 130 is transmitted to the transmission shaft 120 and converted into a rotational movement of the transmission shaft 120.

Optionally, a first end of the torsion spring 130 may be connected to a first end of the transmission shaft 120, a second end of the torsion spring 130 may be connected to the sleeve 140, and a movement gap exists between the sleeve 140 and the first end of the transmission shaft 120. In this way, the torsion spring 130, the transmission shaft 120 and the sleeve 140 are connected, and the presence of the movement gap provides a displacement space for an axial telescopic movement accompanying a rotation of the torsion spring 130 when it is compressed. More specifically, a positioning protrusion 121 may be disposed on the transmission shaft 120, and the first end of the torsion spring 130 is wound around the positioning protrusion 121; a mounting groove 141 is disposed at one end of the sleeve 140 that faces the transmission shaft 120, and a second end of the torsion spring 130 is snapped into the mounting groove 141. This provides a more specific connection between the torsion spring 130, the transmission shaft 120 and the sleeve 140 to ensure the stability and efficiency of the entire energy storage device.

Optionally, as a specific implementation, the ratchet wheel assembly 150 includes: a ratchet wheel 151 having ratchets 151*a* disposed on an inner circumference; and a roller 152 having a pawl 152*a* which is engaged with the ratchets 151*a*. In this arrangement, the roller 152 is connected to the sleeve 140 and is rotatable relative to the ratchets 151; and the ratchet wheel 151 is connected to a fixed position to provide a movement reference. For example, when the rescue device includes a base frame 170, the ratchet wheel 151 is fixed to the base frame 170. At this point, in a direction in which the pawl 152*a* does not restrict the ratchets 151*a*, the roller 150 can normally move relative to the ratchet wheel 151 when subjected to a force; and in a direction in which the pawl 152*a* restricts the ratchets 151*a*, the roller 150 is not capable of moving relative to the ratchet wheel 151 even when subjected to a force.

Of course, as a mature mechanism in the field of machinery, in the light of the teachings of the above embodiments, those skilled in the art can envisage that the functions of limiting one-way movement and storing energy can also be achieved with a minor modification to the embodiments. For example, the ratchet wheel can be configured to have ratchets on an outer circumference, and a rolling ring with a pawl can be provided on an outer side of the ratchet wheel, etc. These minor modifications should also be included in the teachings of the present disclosure.

Referring to FIG. 2, the elevator balanced-load rescue device 100 further includes a driving handle 160, and the driving handle 160 is connected to the sleeve 140 via the ratchet wheel assembly 150, so that the energy storing of the energy storage device and the driving of the clamping wheel set are more conveniently achieved through the rotation of the driving handle. Specifically, when the driving handle 160 rotates in a first direction, the roller 152 rotates relative to the ratchet wheel 151 and drives the sleeve 140 to rotate; and when the driving handle 160 rotates in a second direction opposite to the first direction, the pawl 152*a* on the roller 152 limits a rotation of the roller 152 relative to the ratchet wheel 151. More specifically, the driving handle 160 is configured to have a rotary handle that is perpendicular to the transmission shaft and a handheld handle that extends and protrudes from a terminal end of the rotary handle, thus making the operation more convenient.

In addition, optionally, the elevator balanced-load rescue device 100 further includes a tensioning device 180, which is associated with the driving wheel 111 and the driven wheel 112 of the clamping wheel set 110; wherein in the clamping position, the tensioning device 180 tensions the driving wheel 111 and the driven wheel 112 to clamp the traction belt 210 in order to drive the traction belt 210; and in the releasing position, the tensioning device 180 releases the tensioning of the driving wheel 111 and the driven wheel 112 to release the traction belt 210 so as not to affect the normal operation of the elevator system. As a specific implementation, the tensioning device 180 can include a linkage mechanism connected between the driving wheel 111 and the driven wheel 112.

More specifically, the tensioning device 180 described herein can press the driving wheel 111 and the driven wheel 112 from both ends so that the traction belt is clamped, or the tensioning device 180 can pull the driving wheel 111 and the driven wheel 112 tightly from both ends so that the traction belt is clamped; similarly, the tensioning device 180 can pull the driving wheel 111 and the driven wheel 112 away from a state of clamping the traction belt so that they release the traction belt, or the tensioning device 180 can push the driving wheel 111 and the driven wheel 112 away from a state of clamping the traction belt so that they release the traction belt, as long as the effects of tensioning and releasing tension can be achieved.

On the other hand, optionally, surface layers of the driving wheel 111 and the driven wheel 112 of the clamping wheel set 110 may also be made of a non-metallic material, such as polyurethane, so that when the driving wheel 111 and the driven wheel 112 are clamping the traction belt, a certain protection can be provided to prevent the traction belt from being excessively worn. In still another aspect, optionally, the elevator balanced-load rescue device 100 further includes a base frame 170. In this case, the clamping wheel set 110, the transmission shaft 120, and the energy storage device are all suspended above or below the base frame 170. More specifically, in a state of use, the elevator balanced-load rescue device 100 is installed to a machine beam 220 or a machine base in an elevator machine room via both ends of the base frame 170, thereby achieving the set-up of the entire device. Such an arrangement enables the elevator balanced-load rescue device to be installed here for a long term, and to be sold or used as a whole with the elevator system, thereby improving the rescue efficiency; also, the elevator balanced-load rescue device can be temporarily set up when an application thereof is required, thereby reducing the cost of elevator procurement, while also presenting excellent installation and rescue efficiencies.

In addition, optionally, the clamping wheel set 110 may be disposed adjacent to an end of the base frame 170; or it may be disposed in a middle portion of the base frame 170. Also, optionally, the clamping wheel set 110 has a width over which one or more traction belts 210 are clamped. Further, optionally, the clamping wheel set 110 is disposed above the elevator car or above the elevator counterweight. These configurations depend on specific arrangements of different types of elevators in the hoistway, as well as the required clamping force, etc. In the light of the teachings of the present disclosure, those skilled in the art can select or adjust these features depending on the actual situation.

Furthermore, the elevator balanced-load rescue device 100 further includes a safety switch 190 connected to an elevator circuit and associated with the clamping wheel set 110; wherein the safety switch 190 shuts down a power supply of the elevator when the driving wheel 111 and the driven wheel 112 of the clamping wheel set 110 clamp the traction belt 210. This ensures that the power supply of the elevator system is completely shut down before the rescue work is carried out, and the possibility of other safety accidents is completely eradicated.

Additionally, an embodiment of an elevator is also provided herein. The elevator may include one or more sets of the elevator balanced-load rescue devices according to any of the foregoing embodiments or a combination thereof, and the elevator also has corresponding technical effects.

Referring to FIG. 6, in a case that the elevator has a plurality of sets of the elevator balanced-load rescue devices according to any of the foregoing embodiments or a combination thereof, it can provide greater torque than a single set of elevator balanced-load rescue device, thereby driving a heavier elevator car and counterweight. Of course, in an ideal state, the same effect can be achieved by increasing an energy storage capacity of the energy storage device or specifically increasing the torque to a torque that the torsion spring can withstand. However, in the actual situation, this method imposes extremely high requirements on a single energy storage device or torsion spring, which may lead to a significant increase in cost. Therefore, by contrast, the use a plurality of sets of elevator balanced-load rescue devices may have better cost-effectiveness and performance.

More specifically, optionally, in this arrangement, a plurality of sets of elevator balanced-load rescue devices 100 are respectively disposed in an elevator machine room in the vertical direction. Also, optionally, clamping wheel sets 110 of the plurality of sets of the elevator balanced-load rescue device 100 are respectively disposed above an elevator car and/or above an elevator counterweight. These configurations depend on specific arrangements of different types of elevators in the hoistway, etc. In the light of the teachings of the present disclosure, those skilled in the art can select or adjust these features depending on the actual situation.

Moreover, although not shown in the drawings, an embodiment of an elevator balanced-load rescue method is also provided herein. The rescue method can be applied to the elevator balanced-load rescue devices according to any of the foregoing embodiments or a combination thereof; and the rescue method can also be applied to other elevator balanced-load rescue devices, as long as the elevator balanced-load rescue device includes: a clamping wheel set having a driving wheel and a driven wheel configured to clamp and release a traction belt; an energy storage device configured to store and transmit energy; and a transmission shaft configured to connect the energy storage device and the clamping wheel set.

Specifically, in the rescue mode, the method includes: powering off and closing a tractor brake of the elevator so that an elevator car and an elevator counterweight are locked and stationary, and controlling the clamping wheel set 110 to clamp the traction belt 210 between the elevator car and the elevator counterweight; then controlling the energy storage device to store a mechanical energy and converting the mechanical energy into a torque to be transmitted to the transmission shaft 120; driving the transmission shaft 120 to transmit the torque to the driving wheel 111; thereafter, releasing the tractor brake of the elevator so that the driving wheel 111 drives the driven wheel 112 and the traction belt 210 to move, thereby driving the elevator car and the elevator counterweight to move. In this way, a traction is achieved for the elevator traction belt in an accidental state, so that the elevator car can be towed to an adjacent floor for the passengers to leave safely.

In a more specific rescue method, in a case that the energy storage device includes the torsion spring 130, the sleeve 140, and the ratchet wheel assembly 150, the method may further include: when the roller 152 rotates relative to the ratchet wheel 151 in a first direction, transmitting a rotational movement of the roller 152 to the torsion spring 130 via the sleeve 140 and converting the rotational movement into an elastic energy of the torsion spring 130, and transmitting the elastic energy of the torsion spring 130 to the transmission shaft 120 and converting it into a rotational movement of the transmission shaft 120; and when the roller 152 rotates in a second direction opposite to the first direction, limiting a rotation of the roller 152 relative to the ratchet wheel 151 by a pawl **152*a* on the roller 152, and maintaining the sleeve 140, the torsion spring 130 and the transmission shaft 120** in the current state. Therefore, the rescue operation of the elevator balanced-load rescue device is implemented stepwise. For example, when the device rotates in the first direction, it can tow the clamped traction belt, and when the device rotates in the second direction, no traction action is performed at all.

Optionally, when the elevator balanced-load rescue device 100 includes a safety switch 190 which is connected to an elevator circuit and associated with the clamping wheel set 110, the method further includes: shutting down a power supply of the elevator by the safety switch 190 when the driving wheel 111 and the driven wheel 112 of the clamping wheel set 110 clamp the traction belt 210. This ensures that the power supply of the elevator system is completely shut down before the rescue work is carried out, and the possibility of other safety accidents is completely eradicated.

Referring to FIGS. 7 to 9, a working process of the elevator balanced-load rescue device according to the present disclosure is shown.

FIG. 7 shows a non-working state of the elevator balanced-load rescue device 100. The tensioning device 180 pulls the driving wheel 111 and the driven wheel 112 of the clamping wheel set 110 to the releasing position so as not to clamp the traction belt between the elevator car and the elevator counterweight. At this point, even if the energy storage device in the elevator balanced-load rescue device 100 starts to rotate, store energy and drive the driving wheel 111, it does not cause any traction effect on the traction belt, so that the normal operation of the elevator system can be ensured.

FIGS. 8 and 9 show a working state of the elevator balanced-load rescue device 100. The tensioning device 180 presses the driving wheel 111 and the driven wheel 112 of the clamping wheel set 110 to the clamping position, thereby clamping the traction belt. Subsequently, the ratchet wheel assembly 150 is rotated in a forward direction by the driving handle 160, and energy is accumulated for the torsion spring 130 via the sleeve 140. At this point, due to the action of the tractor brake of the elevator, the traction belt is temporarily unable to be driven by the clamping wheel set, and thus the mechanical energy is temporarily stored in the torsion spring 130 in a form of elastic energy. Subsequently, when the tractor brake of the elevator is released, the elastic energy accumulated by the torsion spring 130 is transmitted to the transmission shaft 120 to enable rotation thereof, thereby causing the driving wheel 111 to drive the driven wheel 112 and the traction belt to rotate, which is convenient for the traction belt to tow the elevator car and counterweight and for achieving the traction of the elevator car to a required floor.

The elevator balanced-load rescue device, elevator, and elevator balanced-load rescue method according to the present disclosure are mainly described in the above examples. While only some of the embodiments of the present disclosure have been described, those skilled in the art will understand that the present disclosure can be carried out in many other forms without departing from the spirit and scope thereof. Therefore, the illustrated examples and embodiments should be considered as illustrative rather than limiting, and the present disclosure can cover various modifications and replacements without departing from the spirit and scope of the present disclosure defined by individual appended claims.

What is claimed is:

1. An elevator balanced-load rescue device, comprising:

a clamping wheel set comprising a driving wheel and a driven wheel that cooperate with each other; wherein the clamping wheel set has a clamping position and a releasing position; in the clamping position, the driving wheel and the driven wheel move toward each other to clamp a traction belt connected between an elevator car and an elevator counterweight; and in the releasing position, the driving wheel and the driven wheel move opposite to each other to release the traction belt;

a transmission shaft which has a first end connected to the driving wheel of the clamping wheel set, and which transmits a torque to the driving wheel; and an energy storage device associated with the transmission shaft;

wherein the energy storage device is configured to store a mechanical energy, and to convert the mechanical energy into a torque to be transmitted to the transmission shaft;

wherein the energy storage device comprises a torsion spring disposed around the transmission shaft.

2. The elevator balanced-load rescue device according to claim 1, further comprising a tensioning device which is associated with the driving wheel and the driven wheel of the clamping wheel set; wherein in the clamping position, the tensioning device tensions the driving wheel and the driven wheel to clamp the traction belt; and in the releasing position, the tensioning device releases the tensioning of the driving wheel and the driven wheel to release the traction belt.

3. The elevator balanced-load rescue device according to claim 2, wherein the tensioning device comprises a linkage mechanism connected between the driving wheel and the driven wheel.

4. The elevator balanced-load rescue device according to claim 1, wherein a surface layer of the driving wheel and/or the driven wheel of the clamping wheel set is made of a non-metallic material.

5. The elevator balanced-load rescue device according to claim 1, further comprising a base frame, to which the clamping wheel set, the transmission shaft and the energy storage device are connected.

6. The elevator balanced-load rescue device according to claim 5, wherein both ends of the base frame are installed to a machine beam or a machine base in an elevator machine room.

7. The elevator balanced-load rescue device according to claim 5, wherein the clamping wheel set is disposed adjacent to an end of the base frame; or the clamping wheel set is disposed in a middle portion of the base frame.

8. The elevator balanced-load rescue device according to claim 1, further comprising a safety switch connected to an elevator circuit, which is associated with the clamping wheel set; wherein the safety switch shuts down a power supply of the elevator when the driving wheel and the driven wheel of the clamping wheel set clamp the traction belt.

9. The elevator balanced-load rescue device according to claim 1, wherein the clamping wheel set has a width over which one or more traction belts are clamped.

10. The elevator balanced-load rescue device according to claim 1, wherein the clamping wheel set is disposed above an elevator car or above an elevator counterweight.

11. An elevator, comprising one or more sets of the elevator balanced- load rescue devices according to claim 1.

12. The elevator according to claim 11, wherein a plurality of sets of the elevator balanced-load rescue devices are respectively disposed in an elevator machine room in a vertical direction.

13. The elevator according to claim 11, wherein clamping wheel sets of a plurality of sets of the elevator balanced-load rescue devices are respectively disposed above an elevator car and/or above an elevator counterweight.

14. An elevator balanced-load rescue device, comprising:

a clamping wheel set comprising a driving wheel and a driven wheel that cooperate with each other; wherein the clamping wheel set has a clamping position and a releasing position; in the clamping position, the driving wheel and the driven wheel move toward each other to clamp a traction belt connected between an elevator car and an elevator counterweight; and in the releasing position, the driving wheel and the driven wheel move opposite to each other to release the traction belt;

a transmission shaft which has a first end connected to the driving wheel of the clamping wheel set, and which transmits a torque to the driving wheel; and an energy storage device associated with the transmission shaft; wherein the energy storage device is configured to store a mechanical energy, and to convert the mechanical energy into a torque to be transmitted to the transmission shaft;

wherein the energy storage device comprises: a torsion spring disposed around the transmission shaft; a sleeve sleeved over the torsion spring; and a ratchet wheel assembly connected to the sleeve; wherein two ends of the torsion spring are connected to the transmission shaft and the sleeve respectively, a rotational movement of the ratchet wheel assembly is transmitted to the torsion spring via the sleeve and is converted into an elastic energy of the torsion spring, and the elastic energy of the torsion spring is transmitted to the transmission shaft and is converted into a rotational movement of the transmission shaft.

15. The elevator balanced-load rescue device according to claim 14, wherein a first end of the torsion spring is connected to the first end of the transmission shaft, a second end of the torsion spring is connected to the sleeve, and a movement gap exists between the sleeve and the first end of the transmission shaft.

16. The elevator balanced-load rescue device according to claim 15, wherein a positioning protrusion is disposed on the transmission shaft, the first end of the torsion spring is wound around the positioning protrusion; and/or a mounting groove is disposed at one end of the sleeve that faces the transmission shaft, and the second end of the torsion spring is snapped into the mounting groove.

17. The elevator balanced-load rescue device according to claim 14, wherein the ratchet wheel assembly comprises: a ratchet wheel having ratchets disposed on an inner circumference; and a roller having a pawl, the pawl being engaged with the ratchets;

wherein the roller is connected to the sleeve and is capable of rotating relative to the ratchet wheel, and the ratchet wheel is fixed.

18. The elevator balanced-load rescue device according to claim 17, further comprising a driving handle, which is connected to the sleeve via the ratchet wheel assembly; wherein when the driving handle rotates in a first direction, the roller rotates relative to the ratchet wheel and drives the sleeve to rotate; and when the driving handle rotates in a second direction opposite to the first direction, the pawl on the roller limits a rotation of the roller relative to the ratchet wheel.

19. The elevator balanced-load rescue device according to claim 17, further comprising a base frame, to which the ratchet wheel is fixed.

20. An elevator balanced-load rescue method, which is used for an elevator balanced-load rescue device, the elevator balanced-load rescue device comprising: a clamping wheel set having a driving wheel and a driven wheel configured to clamp and release a traction belt; an energy storage device configured to store and transmit energy; and a transmission shaft configured to connect the energy storage device and the clamping wheel set; wherein in a rescue mode, the method comprises:

powering off and closing a tractor brake of the elevator so that an elevator car and an elevator counterweight are locked and stationary, and controlling the clamping wheel set to clamp the traction belt;

controlling the energy storage device to store a mechanical energy and converting the mechanical energy into a torque to be transmitted to the transmission shaft, and driving the transmission shaft to transmit the torque to the driving wheel; and releasing the tractor brake of the elevator so that the driving wheel drives the driven wheel and the traction belt to move, thereby driving the elevator car and the elevator counterweight to move;

wherein the energy storage device comprises a torsion spring disposed around the transmission shaft.

21. The elevator balanced-load rescue method according to claim 20, wherein in a case that the elevator balanced-load rescue device comprises a safety switch which is connected to an elevator circuit and associated with the clamping wheel set, the method further comprises: shutting down a power supply of the elevator by the safety switch when the driving wheel and the driven wheel of the clamping wheel set clamp the traction belt.

22. An elevator balanced-load rescue method, which is used for an elevator balanced-load rescue device, the elevator balanced-load rescue device comprising: a clamping wheel set having a driving wheel and a driven wheel configured to clamp and release a traction belt; an energy storage device configured to store and transmit energy; and a transmission shaft configured to connect the energy storage device and the clamping wheel set; wherein in a rescue mode, the method comprises:

powering off and closing a tractor brake of the elevator so that an elevator car and an elevator counterweight are locked and stationary, and controlling the clamping wheel set to clamp the traction belt;

controlling the energy storage device to store a mechanical energy and converting the mechanical energy into a torque to be transmitted to the transmission shaft, and driving the transmission shaft to transmit the torque to the driving wheel; and releasing the tractor brake of the elevator so that the driving wheel drives the driven wheel and the traction belt to move, thereby driving the elevator car and the elevator counterweight to move;

wherein in a case that the energy storage device comprises a torsion spring, a sleeve, and a ratchet wheel assembly, the method further comprises:

when a roller rotates relative to the ratchet wheel in a first direction, transmitting a rotational movement of the roller to the torsion spring via the sleeve and converting the rotational movement into an elastic energy of the torsion spring, and transmitting the elastic energy of the torsion spring to the transmission shaft and converting it into a rotational movement of the transmission shaft; and when the roller rotates in a second direction opposite to the first direction, limiting a rotation of the roller relative to the ratchet wheel by a pawl on the roller, and maintaining the sleeve, the torsion spring and the transmission shaft in a current state.

* * * * *